United States Patent [19]

Ohtsu et al.

[11] Patent Number: 4,833,432

[45] Date of Patent: May 23, 1989

[54] SATURABLE REACTOR FOR USE IN SELF-CONVERGENCE SYSTEM FO DEFLECTION YOKE

[75] Inventors: Shinji Ohtsu; Shunji Arai, both of Tokyo; Yoshimitsu Takamatsu, Yokohama, all of Japan

[73] Assignee: Denki Onkyo Co., Ltd., Tokyo, Japan

[21] Appl. No.: 934,890

[22] Filed: Nov. 25, 1986

[30] Foreign Application Priority Data

| | | | |
|---|---|---|---|
| Nov. 26, 1985 | [JP] | Japan | 60-265712 |
| Jan. 24, 1986 | [JP] | Japan | 61-8487[U] |
| Jan. 24, 1986 | [JP] | Japan | 61-8488[U] |

[51] Int. Cl.[4] ..... H01F 1/00

[52] U.S. Cl. ..... 335/212; 335/213

[58] Field of Search ..... 335/210, 212, 213; 313/421, 426, 427, 430, 431

[56] References Cited

U.S. PATENT DOCUMENTS

| | | | |
|---|---|---|---|
| 3,743,984 | 7/1973 | Takenaka et al. | 335/212 |
| 4,034,324 | 7/1977 | Sano et al. | 335/212 |
| 4,445,101 | 4/1984 | Kobayashi et al. | 335/210 |
| 4,642,528 | 2/1987 | Kobayashi et al. | 335/210 |

*Primary Examiner*—George Harris

*Attorney, Agent, or Firm*—Armstrong, Nikaido, Marmelstein & Kubovcik

[57] ABSTRACT

The saturable reactor employs two dual drum cores having two winding portions which are sandwiched by two common permanent magnets to statically bias the magnetism. Each winding portion of each drum core is wound with two impedance coils which are individually series-connected to the either of two horizontal deflection coils. Two drum cores are inserted into the common control coils. When a horizontal deflection current is supplied to the impedance coils and a vertical deflection current is supplied to the control coil, the current which flows in a pair of horizontal deflection coils varies differentially in a vertical deflection cycle to minimize misconvergence.

5 Claims, 4 Drawing Sheets

SATURABLE REACTOR FOR USE IN SELF-CONVERGENCE SYSTEM FO DEFLECTION YOKE

BACKGROUND OF THE INVENTION

The present invention relates to a saturable reactor to be employed in a television set and a cathode-ray tube display, particularly a saturable reactor suited to be built in a deflection yoke for the in-line type cathode-ray tube having the self convergence system.

Lately, an in-line type cathode-ray tube in which electron beams are emitted in a horizontal arrangement is widely used. In this cathode-ray tube, three electron beams can be converged within the specified tolerance over the full range of the screen only with the deflection yoke by generating the horizontal deflection field of the deflection yoke at a pin-cushion type field and the vertical deflection field as a barrel type field.

In other words, in case of a cathode-ray tube with a small deflection angle of approximately 70°, both primary and secondary convergence errors can be within the tolerances.

However, if the deflection angle is large, for example, 100° or 110°, the difference between the distance from the center of deflection to the imaginary spherical surface and the distance from the center of deflection to the screen increases and the raster on the screen is affected not only by the primary and secondary convergence errors but by a higher order convergence error. It is difficult to make a deflection deflection yoke in which these convergence errors are simultaneously controlled to be within the tolerance only by the deflection coils.

For example, if a deflection yoke which generates a deflection yoke with generates a deflection field as described above is employed in a cathode-ray tube with a large deflection angle, a cross misconvergence as shown in FIG. 1 is generated. When the horizontal direction of the screen is assumed as the X axis and the vertical direction as the Y axis, an S-ing misconvergence occurs at upper and lower end parts $Y_T$ and $Y_B$ of the screen in the Y-axis direction and a positive cross (plus trapezoidal) misconvergence occurs at the four-divided positions of the screen in the Y-axis direction or the middle parts $Y_{TM}$ and $Y_{BM}$ in the Y-axis direction despite the rasters of blue beam B and red beam R positioned at right and left sides of the axis of the cathode-ray tube are converged at every point on the X and Y axes.

These different types of misconvergences which appear simultaneously on the screen cannot be eliminated by a simple means such as addition of a magnetic member and, if a convergence device is employed, the misconvergence remains on a part of the screen and the picture quality cannot therefore be improved.

The above-mentioned S-ing misconvergence can be changed to a positive cross misconvergence as shown in FIG. 2 by varying the distribution or shape of conductor winding of the saddle horizontal deflection coil or applying a single or plural sheets of magnetic members to the surface of the coil. However, the magnitude of the misconvergence at the middle part S1 and the end part $PQ_V$ in the X-axis direction which are at the upper and lower end parts $Y_T$ and $Y_B$ of the screen is not proportional to that of the misconvergence at the middle part S2 and the end part S3 in the X-axis direction which are on the middle parts $Y_{TM}$ and $Y_{BM}$ of the screen, and, even if the convergence device is employed, the misconvergence remains in the rasters and such high quality picture as demanded for displaying characters cannot be obtained.

SUMMARY OF THE INVENTION

An object of the present invention is to provide a saturable reactor to be employed in a deflection yoke having a self-convergence system which allows the convergence of three electron beams within the tolerance over the full range of the screen of the in-line type cathode-ray tube.

Another object of the present invention is to provide a saturable reactor which can vary differentially the horizontal deflection current flowing through two saddle horizontal deflection coils in the vertical deflection cycle and is thus suited to eliminate the cross misconvergence on the screen.

The following describes the features of the saturable reactor in accordance with the present invention.

The first and second dual drum cores which have the first and second winding portions, respectively, are arranged in parallel with a certain specified clearance. Two common permanent magnets are provided with the same polarity parts opposingly contacted at both ends of these drum cores to statically bias the magnetism of the drum cores.

The first winding portions of the first and second drum cores are adapted to be respectively wound with the first impedance coil and connected in series to the first horizontal deflection coil, and the second winding portions of the first and second drum cores are adapted to be respectively wound with the second impedance coil and connected in series to the second horizontal deflection coils. With this adaptation, magnetic fluxes having opposing directions occurs at the first and second winding portions of each drum core when the horizontal deflection current is supplied. Two drum cores are inserted inside the common control coil. The control coil is connected in series to a pair of vertical deflection coils and, when the vertical deflection coil is supplied, the magnetic fluxes of the same direction are generated at the winding portions of the drum cores.

With the above-mentioned configuration of the saturable reactor, the horizontal deflection current flowing through a pair of horizontal deflection coils is differentially varied at the deflection cycle of the vertical deflection current to correct the cross misconvergence.

DETAILED DESCRIPTION OF THE INVENTION

Figure 3:
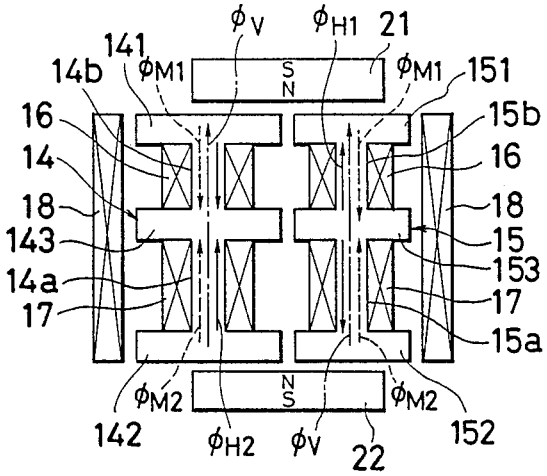
FIG. 3 is a brief configuration of the saturable reactor in accordance with the present invention.

FIG. 3 shows a rough construction of the saturable reactor in accordance with the present invention. A pair of dual drum cores 14, 15 are arranged in parallel with a certain specified clearance and common permanent magnets 21, 22 are arranged closely to each other with the same polarities, for example, N polarities opposed at both ends of these dual drum cores. The dual drum core herein used is a core which is made of a material with high magnetic permeability such as, for example, ferrite and provided with disk-shaped flanges 141, 142, 143, 151, 152 and 153 at both ends and the center of the bar type magnetic core and with winding portions 14*a*, 14*b*, 15*a*, and 15*b* around the coils are to be wound between these flanges.

Common impedance coil 17 is wound around the winding portions 14*a*, 15*a* of the drum cores 14, 15 and another common impedance coil 16 is wound around the winding portions 14*b*, 15*b*. The control coil 18 wound around the coil bobbin not shown is arranged around a pair of dual drum cores 14, 15.

Said impedance coils 16, 17 and the control coil 18 are connected to the horizontal deflection coil and the vertical deflection coil of the deflection yoke.

Figure 4:
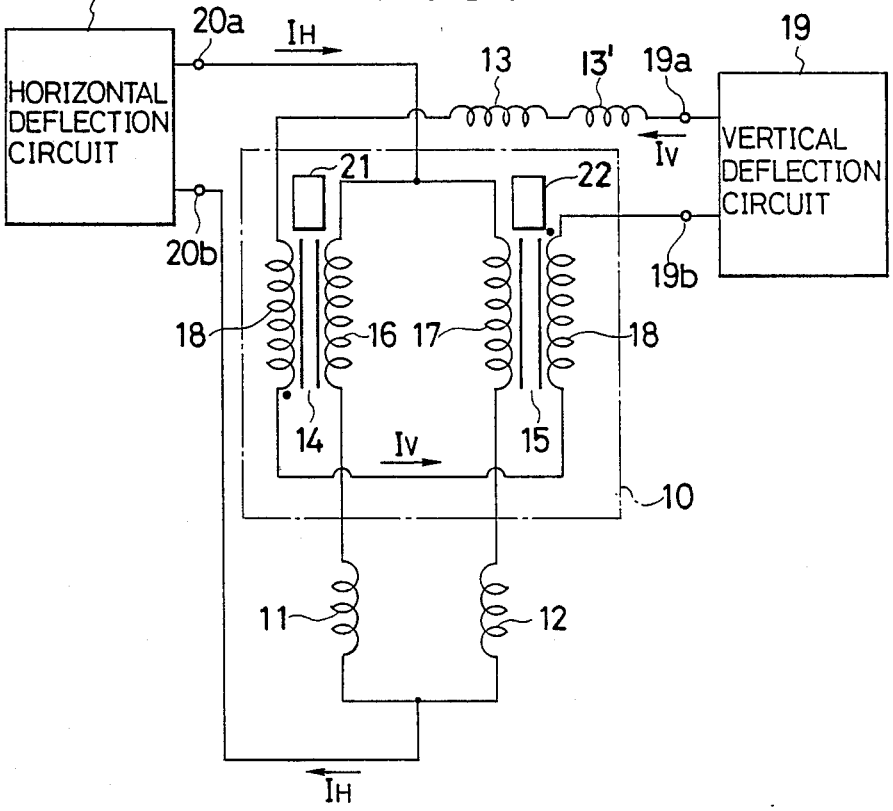
FIG. 4 is a circuit diagram showing the connections between the coils comprising the saturable reactor of the present invention and the deflection coils of the deflection yoke.

FIG. 4 shows the electrical circuit of the deflection yoke and the saturable reactor is shown inside the one-dotted broken line 10. One-side ends of impedance coils 16, 17 are directly connected to the terminals 20*a* of the horizontal deflection circuit 20 and the other ends are respectively connected to one-side ends of the horizontal deflection coils 11, 12 and the other end of the horizontal deflection coil is connected to the terminal 20*b* of the horizontal deflection coil 20. In other words, the series circuit of the horizontal deflection coil and the impedance coil is connected in parallel to the horizontal deflection circuit 20.

On the other hand, the control coil 18 is connected to the terminal 19*a* of the vertical deflection circuit 19 through the vertical deflection coils 13, 13', which are connected in series, and the other end of the coil 18 is connected to the terminal 19*b* of the circuit 19.

The following describes the operation of the saturable reactor. When the vertical deflection current $I_V$ from the vertical deflection circuit 19 is supplied to the control coil 18 and the horizontal deflection current $I_H$ supplied from the horizontal deflection circuit 20 flows through the the impedance coils 16, 17, a magnetic flux is generated in the direction as shown with the arrowhead in FIG. 3. In other words, a control flux $\phi_V$ in the arrowhead direction shown with a one-dotted broken line is generated by the control coil 18 in the winding portions 14*a*, 14*b*, 15*a* and 15*b* of the drum cores 14, 15 and the magnetic fluxes $\phi$H1, $\phi$H2 from the impedance coils 16, 17 are generated as shown with the solid arrowhead so that the directions of magnetic flux $\phi$H2 passing through the winding portions 14*a*, 15*a* and magnetic flux $\phi$H1 passing through the winding portions 14*b*, 15*b* are reversed. These magnetic fluxes $\phi$H1, $\phi$H2 pass through the closed magnetic path formed by the flanges 141–143, 151–153 and the winding portions 14*a*, 15*a*, 14*b* and 15*b* of the drum core.

Magnets 21, 22 add the biased magnetic fluxes $\phi$M1, $\phi$M2 shown with reversed arrowheads to the winding portions 14*a*, 14*b*, 15*a*, 15*b* as shown with a broken line and return to the magnets from the flanges 143, 153 through the space magnetic path.

The directions of magnetic fluxes $\phi$V, $\phi$H1, $\phi$H2 shown in FIG. 3 only indicate the timing when deflection currents $I_V$, $I_H$ exist. In fact, these directions vary at every half cycle of deflection currents $I_V$, $I_H$ supplied to impedance coils 16, 17 and the control coil 18.

As known from FIG. 3, since the magnetism of the winding portions 14*a*, 15*b* of the drum cores are biased to $\phi V+\phi M2$, it becomes equivalent to the reduction of magnetic permeabilities of the drum cores whereby the inductance of the impedance coil 17 also reduces. In other words, the impedance of the impedance coil 17 reduces and the amount of current of the horizontal deflection current $I_H$ flowing through the horizontal deflection coil 12 slightly increases or does not nearly increase. This is because the cores are magnetically biased up to a point near the saturation point of the B-H curve which depends on the material of the drum cores.

On the other hand, since the winding portions 14*b*, 15*b* are magnetically biased to $\phi V-\phi M1$, such bias becomes equivalent to an increase of the magnetic permeability, the impedance of the impedance coil 16 increases and the horizontal deflection current flowing through the horizontal deflection coil 11 reduces.

Figure 1:
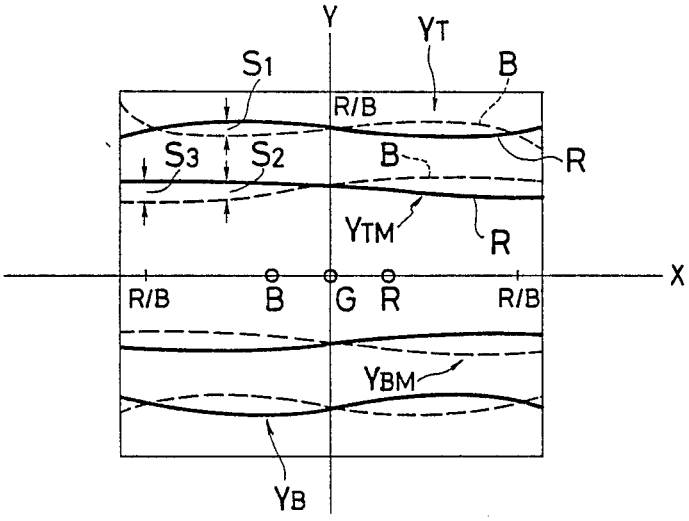
FIG. 1 PRIOR ART
FIG. 1 and FIG. 2 are respectively an embodiment of the cross misconvergence which appears on the in-line type cathode-ray tube when three electron beams are deflected by means of the deflection yoke.
Figure 2:
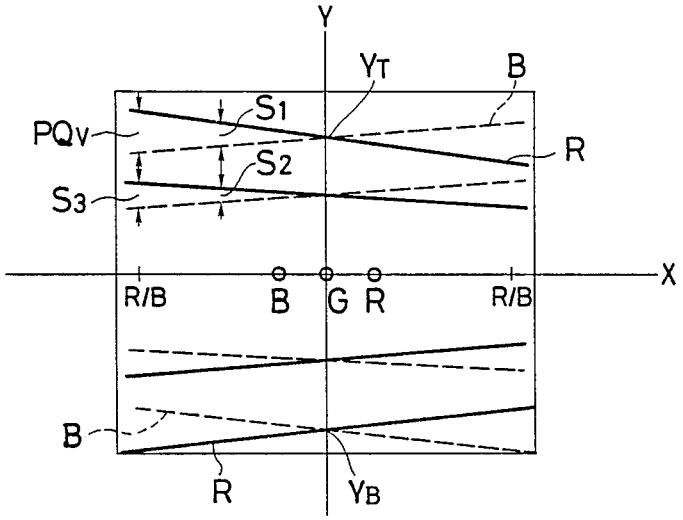
FIG. 2 PRIOR ART

The above-mentioned operation is carried out in a cycle of the vertical deflection current and the horizontal deflection current flowing through the horizontal deflection coils 11, 12 is differentially varied in a cycle of the vertical deflection current. If such deflection current is supplied to the deflection yoke, the cross misconvergence as shown in FIG. 2 is corrected and the amount of misconvergence is within the tolerance. The magnetitude of misconvergence can be adjusted by varying the magnetic flux density of magnetic fluxes $\phi$M1, $\phi$M2 supplied from magnets 21, 22. For example, the balance of magnetic bias against the drum cores 14, 15 can be changed by biasing one or both of magnets 21, 22 to the right or left on the figure. The densities of magnetic fluxes can be varied by reducing the sizes or thickness of the magnets.

Figure 5:
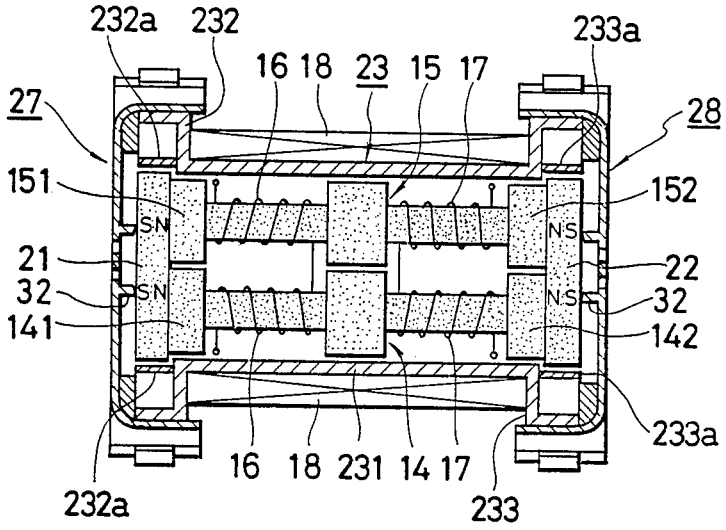
FIG. 5 is a cross section view of the construction of the saturable reactor of the present invention.
Figure 6:
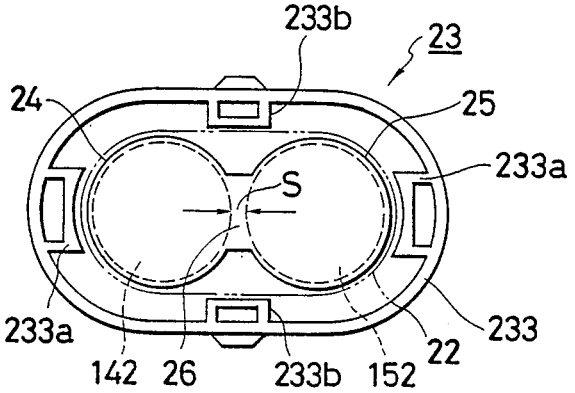
FIG. 6 is a view of the coil bobbin of the saturable reactor shown in FIG. 5.
Figure 7:
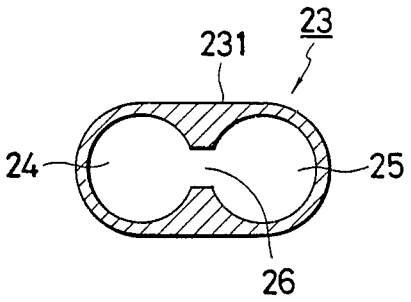
FIG. 7 is a view of the cross section which divides the coil bobbin shown in FIG. 5 into two.

FIGS. 5 to 8 respectively show the structures of embodiments of the saturable reactor in accordance with the present invention. The coil bobbin 23 which is made of a plastic material and formed in an oval profile has the cylindrical part 231 and the enlarged cylindrical parts 232, 233 which are formed at both ends of said cylindrical part 231 around which the control coil 18 is wound. Inside the cylindrical part 231 of the coil bobbin 23, two tubular tunnels 24, 25 are provided which communicate each other through the space 26 as expressly shown by the cross sectional view in FIG. 7. In two tunnels 24, 25 are inserted the dual drum cores 14, 15 around which impedance coils 16, 17 are wound as shown in FIGS. 5 and 6.

In other words, cores 14, 15 are supported by the disk-shaped flanges 141–143, 151–153 from the inside wall of the coil bobbin 23. In this case, the closest parts of flanges 141–143 and 151–153 are separated as much as the width of the partition S so that the fluctuation of the reluctance of the closed magnetic circuit formed by two drum cores 14, 15 is reduced.

Projection members 232*a*, 233*a*, 233*b* which control the positions of magnets 21, 22 are provided in the enlarged cylindrical parts 232, 233 formed at both ends of the coil bobbin 23, as shown in FIG. 5 and FIG. 6, and oval-shaped plate magnets 21, 22 are inserted into the section surrounded by these projection members as shown with the one-dotted broken line. The magnets are magnetized in the direction of thickness.

Figure 8:
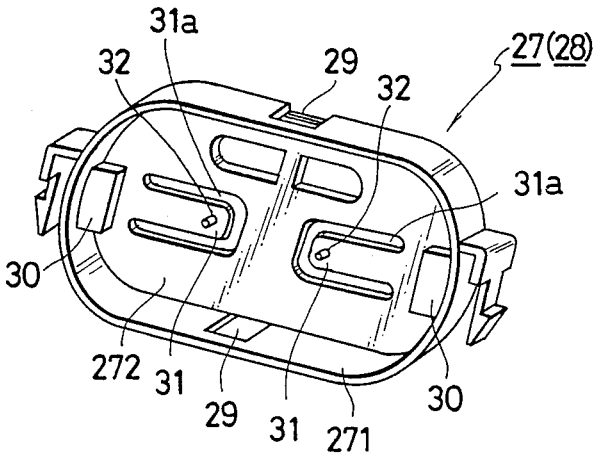
FIG. 8 is a perspective view of the cover shown in FIG. 5 as viewed from the inside.

In addition, the enlarged cylindrical parts 232, 233 are protected with the covers 27, 28 made of a plastic material as shown in FIG. 5. Covers 27, 28 are composed of the oval cylindrical member 271 and the plate member 272 as shown in FIG. 8. The engaging hole 29 is provided at the shorter diameter part of the oval cylindrical member 271 and the stepped stopper 30 is provided at both ends of the plate member 272 in the longer diameter direction. The engaging hole 29 engages with the engaging claws (not shown) provided on the outside of the enlarged cylindrical parts 232, 233 and the stopper 30 hits against the projection members 232*a*, 233*a* inside the enlarged cylindrical parts in order to fix the covers 27, 28 to the enlarged cylindrical parts 232, 233.

Lugs 31 are provided on the plate number 272 of the covers 27, 28 in the direction of the longer diameter. These lugs 31 are formed by providing the U-shaped holes 31*a* in the plate member 272. The lugs 31 are provided with projections 32, which are projected inside the covers 27, 28, at their tip ends to depress the magnets 21, 22 against the flanges 141, 142, 151, 152 of the drum cores as shown in FIG. 5.

Various variations of the embodiment can be made within the range of the objects of the present invention. For example, the permanent magnets can be small-sized to be slidable inside the enlarged cylindrical member and can also be formed in a rectangular or circular shape. The shape of the coil bobbin and the cover can also be changed in the stage of design.

What is Claimed is:

1. A saturable reactor for use in a self-convergence system of a deflection yoke having a pair of horizontal deflection coils and a pair of vertical deflection coils, comprising (a) first and second dual drum cores which are respectively provided with first and second winding portions and partitioned by three flanges, said two drum cores being arranged in parallel, (b) permanent magnets which are provided at both ends of said drum cores with their same polarities closely opposed in order to statically bias a magnetism generated from said winding portions, (c) first and second impedance coils, said first impedance coil being wound around said first winding portion of said drum cores and connected in series to one of said horizontal deflection coils to generate a first magnetic flux which passes through a closed magnetic circuit formed by said winding portions and said flanges, and said second impedance coil also being wound around said second winding portion of said drum cores and connected in series to the other of said horizontal deflection coils to generate a second magnetic flux which passes through a closed magnetic circuit formed by said winding portions and said flanges in a direction opposing to the direction of said first magnetic flux, and (d) a control coil which is connected in series to said vertical deflection coil and inside which said two drum cores are inserted, wherein the impedance of said first and second impedance coils differentially varies in a vertical deflection cycle of a vertical deflection current when a horizontal deflection current flows through said horizontal deflection coil and a vertical deflection current flows through said vertical deflection coil.

2. A saturable reactor in accordance with claim 1, wherein a control coil is wound around a cylindrical part having an oval-shaped profile and said cylindrical part of the coil bobbin having an enlarged cylindrical part formed at both ends of said oval-shaped cylindrical part.

3. A saturable reactor in accordance with claim 1, wherein two tunnels which are extended in a direction from one enlarged cylindrical part to the other enlarged cylindrical part are provided inside said cylindrical part of the coil bobbin and the drum cores around which impedance coils are wound are housed in said tunnels.

4. A saturable reactor in accordance with claim 2, wherein two permanent magnets are housed in said enlarged cylindrical part of the coil bobbin.

5. A saturable reactor in accordance with claim 2, wherein a cover for covering the enlarged cylindrical part of the coil bobbin is provided and a means for depressing said permanent magnets is provided on said cover.

* * * * *